US009649240B2

(12) United States Patent
Cox et al.

(10) Patent No.: US 9,649,240 B2
(45) **Date of Patent: *May 16, 2017**

(54) LIGHTWEIGHT CASKET HAVING FOLDABLE SIDES

(71) Applicant: Vandor Corporation, Richmond, IN (US)

(72) Inventors: Gary L. Cox, Richmond, IN (US); Gerald H. Davis, Fountain City, IN (US); Chad L. Eversole, Richmond, IN (US)

(73) Assignee: Vandor Corporation, Richmond, IN (US)

( * ) Notice: Subject to any disclaimer, the term of this patent is extended or adjusted under 35 U.S.C. 154(b) by 58 days.

This patent is subject to a terminal disclaimer.

(21) Appl. No.: 14/628,703

(22) Filed: Feb. 23, 2015

(65) Prior Publication Data

US 2015/0164729 A1 Jun. 18, 2015

Related U.S. Application Data

(63) Continuation of application No. 13/769,790, filed on Feb. 18, 2013, now Pat. No. 8,959,732, which is a (Continued)

(51) Int. Cl.
*A61G 17/007* (2006.01)
*A61G 17/00* (2006.01)
(Continued)

(52) U.S. Cl.
CPC ..... *A61G 17/0073* (2013.01); *A61G 17/00* (2013.01); *A61G 17/004* (2016.11);
(Continued)

(58) Field of Classification Search
CPC .... A61G 17/0073; A61G 17/02; A61G 17/04; A61G 17/00; A61G 17/007;
(Continued)

(56) References Cited

U.S. PATENT DOCUMENTS 1,850,164 A * 3/1932 Andrews ..... B65D 5/22 229/199
3,346,399 A 10/1967 Watson
(Continued)

OTHER PUBLICATIONS

Kauffman et al., Decision Institution of Inter Partes Review 36 C.F.R. 42.108, Entered Apr. 21, 2016, Case IPR2016-00112, U.S. Pat. No. 8,104,151 B2.

*Primary Examiner* — William Miller
(74) *Attorney, Agent, or Firm* — Maginot, Moore & Beck LLP

(57) ABSTRACT

A casket assembly includes a bottom panel, side panels, flaps and end panels. The bottom panel is formed of a pliable material. The side panels and end panels are coupled to the bottom panel. Each side panel includes a lower section and an upper section foldably attached thereto. The lower section extends vertically upward from the bottom panel. In a first configuration, the upper section extends upward from the lower section. In a second configuration, the upper section extends downward from a top of the lower section. In a third configuration, the upper section extends in a non-vertical direction from the top of the lower section. The flaps extend laterally from each end of the upper section. The flaps in the first configuration extend upward from a first vertical level defined by the top portion of the lower section, and in the second configuration extend downward from the first vertical level.

18 Claims, 10 Drawing Sheets

Related U.S. Application Data continuation of application No. 13/360,333, filed on Jan. 27, 2012, now Pat. No. 8,375,535, which is a continuation of application No. 11/502,637, filed on Aug. 10, 2006, now Pat. No. 8,104,151.

(60) Provisional application No. 60/707,079, filed on Aug. 10, 2005.

(51) Int. Cl.

| | |
|---|---|
| ***A61G 17/02*** | (2006.01) |
| ***A61G 17/04*** | (2006.01) |
| ***F23G 1/00*** | (2006.01) |

(52) U.S. Cl.

CPC ..... *A61G 17/007* (2013.01); *A61G 17/02* (2013.01); *A61G 17/04* (2013.01); *A61G 17/041* (2016.11); *A61G 17/042* (2016.11); *A61G 17/047* (2016.11); *F23G 1/00* (2013.01)

(58) Field of Classification Search

CPC ..... A61G 2017/047; A61G 2017/042; A61G 2017/004; A61G 17/047; A61G 17/042; A61G 17/004; A61G 17/041; F23G 1/00; B65D 5/0005; B65D 5/22; B65D 5/445; B65D 5/003; B65D 5/248; B65D 5/247

USPC ..... 27/2, 4, 19; 229/101, 165, 169, 199, 229/172–176, 186–190; 220/651–653, 220/666, 6

See application file for complete search history.

(56) References Cited

U.S. PATENT DOCUMENTS

| | | | |
|---|---|---|---|
| 3,729,786 | A | 5/1973 | Walding |
| D227,247 | S | 6/1973 | Dittbenner |
| 3,782,619 | A | 1/1974 | Dittbenner |
| 4,101,052 | A | 7/1978 | Dove |
| 4,151,630 | A | 5/1979 | Havey |
| 4,951,367 | A | 8/1990 | Wolfe |
| 5,050,766 | A | 9/1991 | Groh |
| 5,092,020 | A | 3/1992 | MaGuire |
| 5,586,679 | A | 12/1996 | Thomas |
| 5,615,464 | A | 4/1997 | Rojdev |
| 5,623,752 | A | 4/1997 | Gillard |
| 5,771,549 | A | 6/1998 | Saaf |
| 5,775,061 | A | 7/1998 | Enneking et al. |
| 6,145,175 | A | 11/2000 | Enneking et al. |
| 6,154,937 | A | 12/2000 | Enneking et al. |
| 6,317,944 | B1 | 11/2001 | Beaulieu et al. |
| 6,694,579 | B2 | 2/2004 | Belanger et al. |
| 7,197,794 | B2 | 4/2007 | Davis et al. |
| 7,249,403 | B2 | 7/2007 | Davis et al. |
| 7,263,751 | B2 | 9/2007 | Davis et al. |
| 7,322,079 | B2 | 1/2008 | Davis et al. |
| 7,337,484 | B2 | 3/2008 | Cox |
| 8,079,119 | B1 | 12/2011 | Ferko, III |
| 8,375,534 | B2 | 2/2013 | Gesell et al. |
| 2005/0193535 | A1 | 9/2005 | Davis et al. |

* cited by examiner

LIGHTWEIGHT CASKET HAVING FOLDABLE SIDES

This application is a continuation of U.S. patent application Ser. No. 13/769,790, filed Feb. 18, 2013, now U.S. Pat. No. 8,959,732, which is a continuation of U.S. patent application Ser. No. 13/360,333, filed Jan. 27, 2012, now U.S. Pat. No. 8,375,535, which is a continuation of U.S. patent application Ser. No. 11/502,637, now U.S. Pat. No. 8,104,151, filed Aug. 10, 2006, which claims the benefit of U.S. Provisional Patent Application Ser. No. 60/707,079, which was filed on Aug. 10, 2005.

FIELD OF THE INVENTION

The present invention relates generally to caskets, and more particularly, to lightweight caskets.

BACKGROUND OF THE INVENTION

Caskets and cremation containers are constructed from a plurality of materials, including wood, metal, and paper materials, as well as combinations of the foregoing. These caskets and cremation containers vary substantially in price. While wood and metal-based caskets can be expensive, paper-based cremation containers can provide a viable low cost option when cremation is contemplated. In fact, extremely low costs may be achieved by employing a corrugated paper cremation container, which is a fraction of the cost of hardwood or metal caskets. Even if cost is not a major consideration, corrugated paper caskets are a popular choice for cremation, in part because they are completely consumed during the cremation process.

Many corrugated paper caskets can have ornamentation and other design elements that approximate decorative wood or steel caskets. Many people find such paper caskets to be suitable for presentation at a viewing and/or funerary service. These ornately designed paper caskets represent a cost savings over hardwood caskets, and are particularly advantageous in cases in which the casket is to be consumed during the cremation process.

While ornately designed paper caskets are less expensive than hardwood caskets, they still represent a significant cost that may not be practical in some cases. In such cases, a more inexpensive option is a simple rectangular corrugated paper container and associated simple rectangular lid that fits over the container in a manner similar to that of a common shoebox. The deceased fits within the container and then the rectangular lid is fitted over the container to close off the casket.

The need for such inexpensive caskets arises in situations of financial need, and also in disaster areas where many deceased are located in a relatively small area. The paper container has significant advantages over traditional caskets in this environment including the ability to transport significant numbers of the lightweight paper casket and the disposability of such caskets.

While cardboard cremation caskets are typically considered to be an economical approach the storage of the deceased, a significant cost nevertheless arises as a result of shipping and storage costs. Even though the caskets are fairly light, they are more or less as bulky as traditional wood and metal caskets. As a result, funerary and/or cremation establishments pay a shipping premium due to the size of the cremation caskets. Additionally, storage of the cremation caskets at a funeral establishment requires a relatively large area. Thus, shipping and storage of lightweight cremation containers can increase costs.

One way in which such costs can be reduced is to ship the container unassembled, which requires less space in shipping and storing. In such a case, the funerary or cremation establishment is required to perform the assembly of the caskets. Assembly of the caskets can be relatively complicated and time consuming, particularly if performed on an intermittent basis at a retail point of sale.

Thus, there is a need for a cremation casket that has reduced shipping costs without requiring complex assembly at the retail point of sale.

Another problem associated with cardboard containers relates to leakage of the contents. Embalming fluids and body fluids can secrete from the body while the body is in the casket. The liquids can leech or soak through the container presenting an undesirable appearance. Pans or containers are often used to collect these fluids, however, these specially made pans also add to the cost of the casket assembly. Thus, there exists a need for a low cost alternative for reducing or preventing leakage.

BRIEF SUMMARY OF THE INVENTION

The inventions described herein have several aspects, each of which individually addresses on or more of the problems of the prior art discussed above, and/or other problems or shortcomings not specifically mentioned, but which will become readily apparent to those of ordinary skill in the art by reference to the following detailed description and accompanying drawings.

A first embodiment is a casket assembly that includes a bottom panel, side panels, flaps and end panels. The bottom panel is formed of a pliable material. The side panels and end panels are coupled to the bottom panel. Each side panel includes a lower section and an upper section foldably attached thereto. The lower section extends vertically upward from the bottom panel. In a first configuration, the upper section extends upward from the lower section. In a second configuration, the upper section extends downward from a top of the lower section. In a third configuration, the upper section extends in a non-vertical direction from the top of the lower section. The flaps extend laterally from each end of the upper section. The flaps in the first configuration extend upward from a first vertical level defined by the top portion of the lower section, and in the second configuration extend downward from the first vertical level.

The above described casket arrangement may be used as a standalone casket, or as an insert to a rental casket structure having a more ornate appearance. In particular, the above described casket arrangement may be inserted into an ornamental rental casket shell for viewing of the body, and then removed and cremated with the body apart from the rental casket shell.

Another exemplary embodiment is a corresponding method for using a casket arrangement having three configurations of an upper section of the side wall.

The above described features and advantages, as well as others, will become more readily apparent to those of ordinary skill in the art by reference to the following detailed description and accompanying drawings.

DETAILED DESCRIPTION

Figure 1:
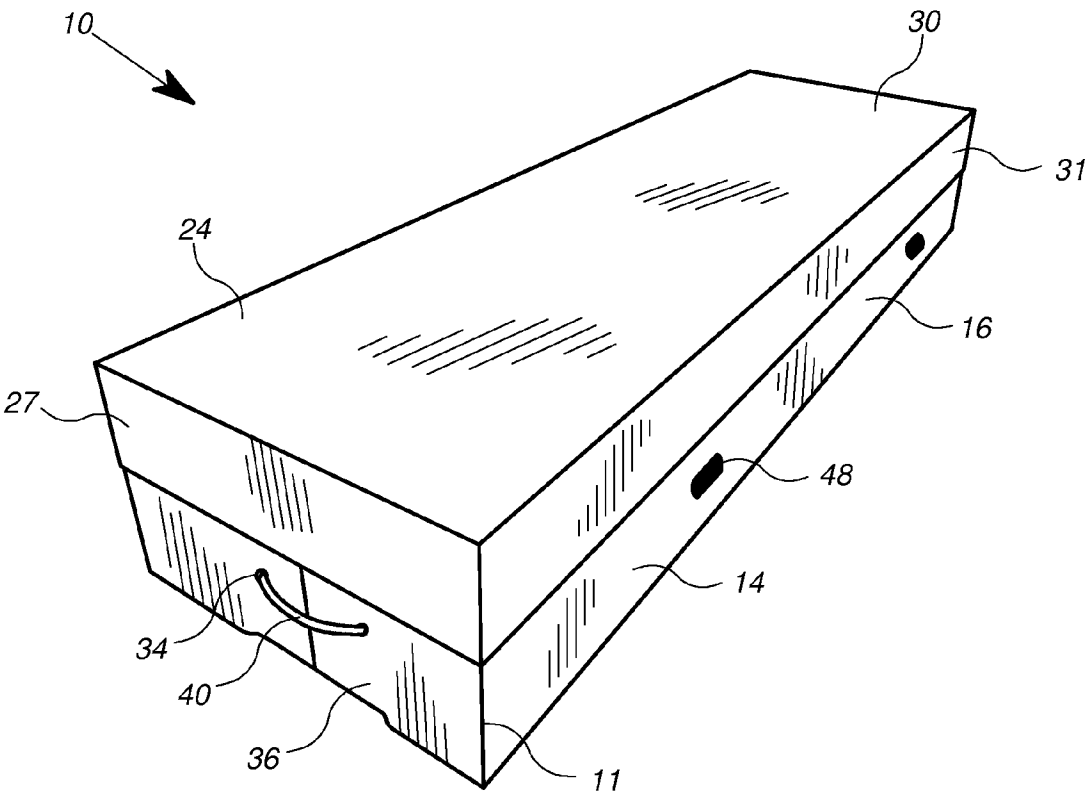
FIG. 1 shows a perspective view of an exemplary embodiment of a rental casket insert in a first configuration according to the present invention.

For the purposes of promoting an understanding of the principles of the invention, reference will now be made to the embodiments illustrated in the drawings and described in the following written description. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 3:
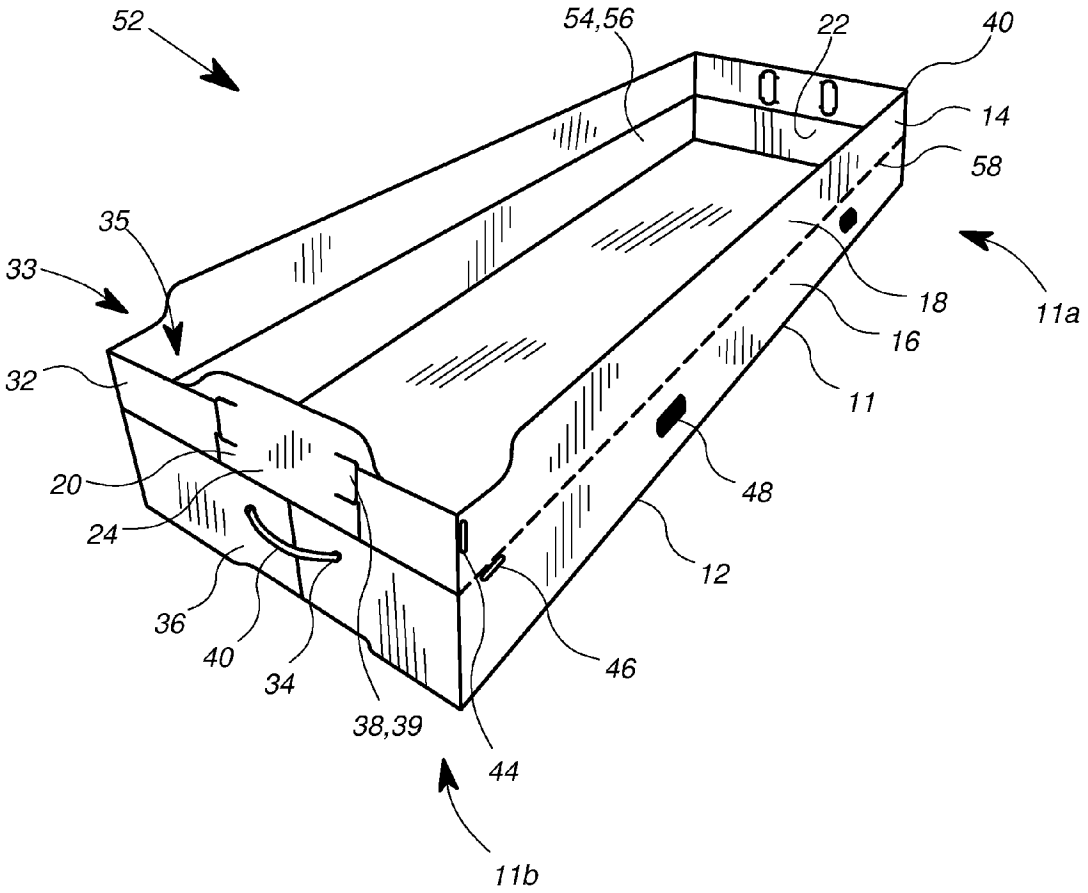
FIG. 3 shows a perspective view of the casket body with insert as assembled in a first configuration.

FIG. 1 shows a casket arrangement 10 that incorporates features of the present invention. The casket arrangement 10 as shown includes a casket body 11 in a first configuration and a lid 30 placed over the casket body 11. In the first configuration of the casket body 11, the casket body 11 forms a container for receiving the body of the deceased. The arrangement 10 as illustrated in FIG. 1 is fully assembled and suitable for use. FIG. 3 shows in further detail the casket body 11 in the first configuration.

The casket arrangement 10 may suitably be used as a standalone casket, or as a rental casket insert. As a standalone casket, the casket arrangement 10 operates as a casket for receiving and moving the body of the deceased. The casket arrangement 10 may suitably be cremated along with the body of the deceased. As a rental insert, the casket arrangement 10 is placed into another casket or casket shell, not shown, but which may suitably be any wood, metal, marble or other ornate casket/coffin structure. Some rental casket shells have hinged foot or head panels that may be opened to facilitate sliding the rental insert (casket arrangement 10) in and out of the rental casket shell. In any event, the casket arrangement 10 is placed within the ornate rental casket for viewing, and then removed to transport the body of the deceased to another location, such as a crematory.

Figure 2:
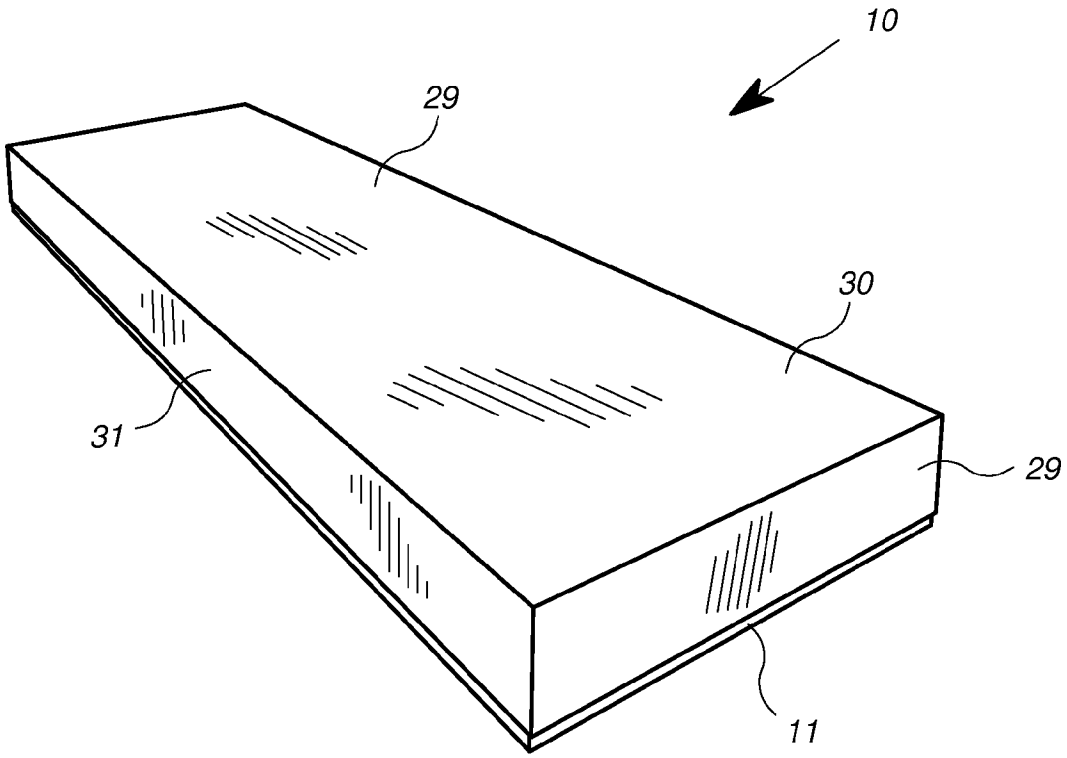
FIG. 2 shows a perspective view of an exemplary embodiment of a rental casket insert in a second configuration according to the present invention.

FIG. 2 shows the casket arrangement 10 with the casket body 11 in a second configuration intended for shipment and/or storage of the casket arrangement 10. The lid 30 is placed over the casket body 11 in the second configuration. The second configuration of the casket body 11 is more suitable for storage and/or shipping because of the lower profile. In the embodiment described herein, the lid 30 hides the casket body 11 from view as shown in FIG. 2. The second configuration of the casket body 11 can be seen in more detail in FIG. 4.

Referring now to FIG. 3, the casket body 11 is shown in an arrangement 52 that also includes a casket insert 54 formed in accordance with a preferred embodiment of the invention. The casket insert 54 in the embodiment described herein is a removable tray assembly that may be used to capture liquids within the casket assembly 10 and prevent leaking thereof. The casket insert 54 also mechanically strengthens the casket assembly 10. The casket insert 54 is shown in further detail in FIGS. 6-9, and is discussed further below.

Figure 5:
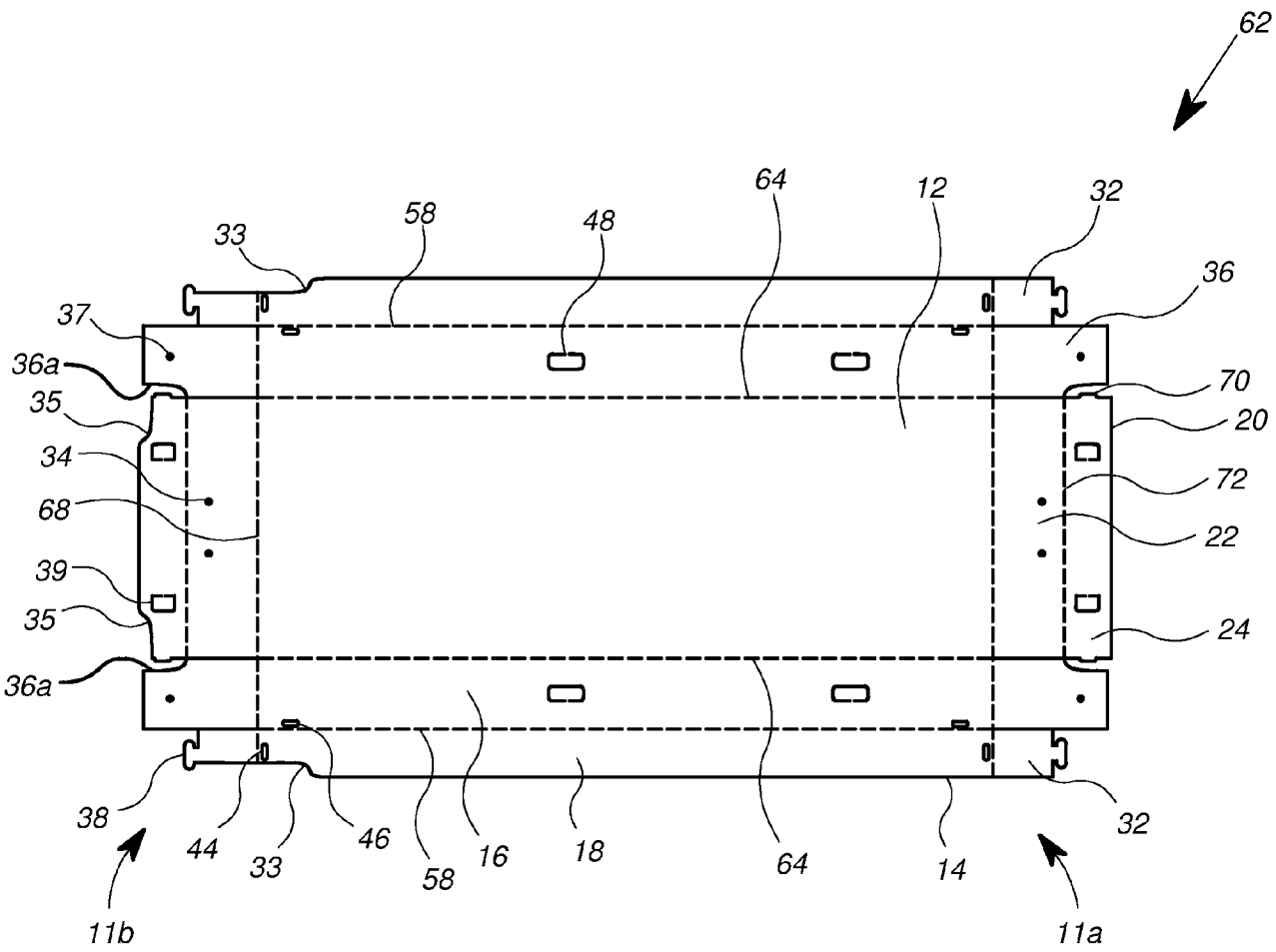
FIG. 5 shows a top elevation view of the blank used to form the casket body.
Figure 6:
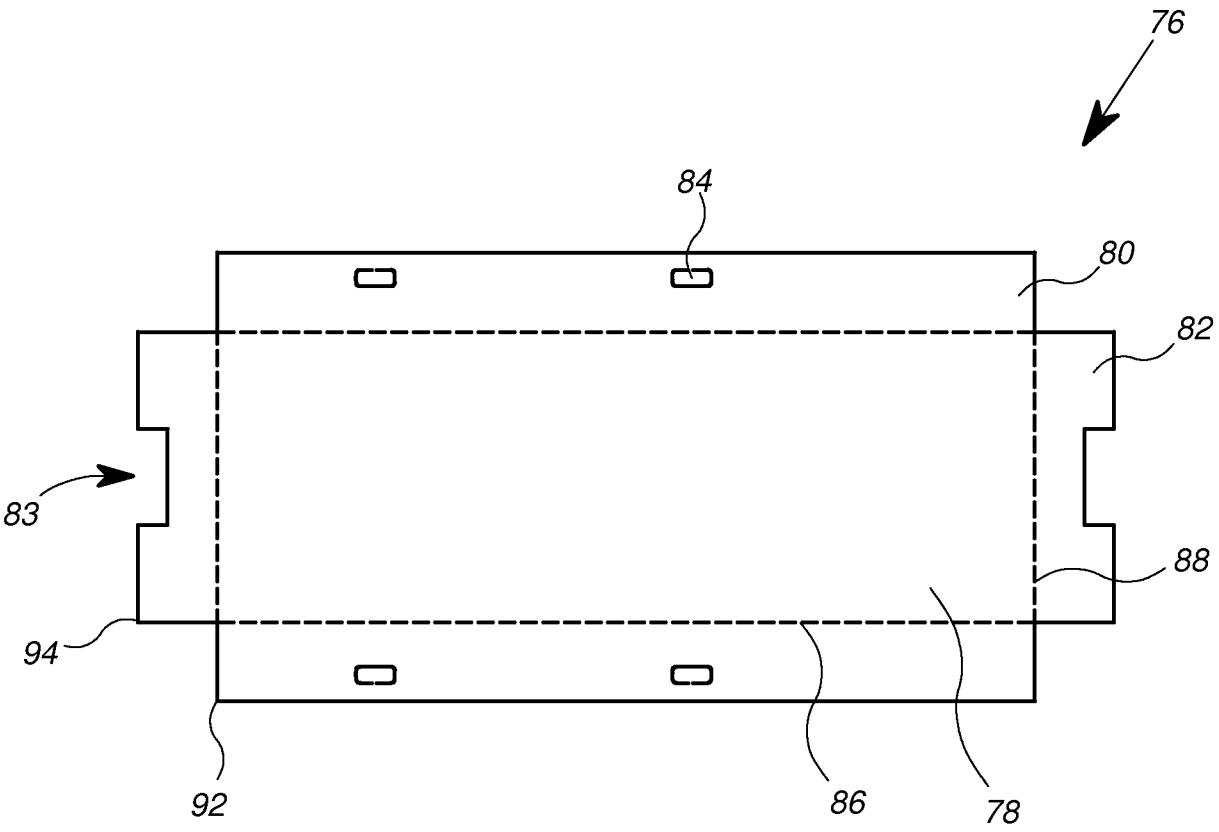
FIG. 6 shows a top elevation view of the blank used to form the casket insert.

With reference to FIGS. 1 and 3, the casket body 11 includes a bottom panel 12, first and second side panels 14, and first and second end panels 20. The casket body 11 in the first configuration is adapted to form a container that receives a body. The bottom panel 12, the side panels 14 and the end panels 20 are preferably formed from a single piece of pliable material, such as corrugated paperboard. To this end, a specially configured blank is first stamped from a continuous piece of paperboard, and then folded to form the casket body 11. Referring now to FIGS. 1, 3 and 5, each side panel 14 has a lower section 16 and an upper section 18. Each lower section 16 is substantially rectangular in shape, and is foldably attached on one elongate side to one of two opposing side edges 64 of the bottom panel 12. Foldably attached to the other elongate side 58 of each lower section 16 is the upper section 18. Attached to each shorter side of each lower section 16 is a lower connecting extension 36. The lower connecting extensions 36 extend laterally from each end of each lower section 16. Each lower connecting extension 36 forms a substantially rectangular flap having a through-hole 37 formed therein. In the embodiment described herein, the lower connecting extension 36 includes cutout section **36*a* on one corner. In the exemplary embodiment described herein, the lower connecting extension 36 has a length that is approximately the same, but slightly less than, one-half of the length of the end panel 20**.

Each upper section 18 is also rectangular in shape and has a length that is coextensive with the lower section 16. As discussed above, one of the elongate sides of the upper section 18 is foldably attached to the elongate side 58 of the lower section 16. Attached to each shorter side of each upper section 18 is an upper connecting extension 32. The upper connecting extensions 32 extend laterally from each end of each upper section 18. Each upper connecting extension 32 forms a substantially rectangular flap having a bulbous tab section 38 extending from the end opposite the end attached to the upper section 18. At the intersection of the upper connecting extension 32 and each corresponding upper section 18 is a small slot 44.

Similarly, each end panel 20 includes a lower end panel 22 and an upper end panel 24. The lower end panel 22 is rectangular in shape and includes through holes 34 which are configured to at least approximately line up with through holes 37 of the lower connecting extensions 36 of corresponding side panels 14 when assembled in either the first or second configuration. Each lower end panel 22 has an elongate edge foldably attached to an end edge 68 of the bottom panel 12. The other elongate edge of each lower end panel 22 is foldably attached to a corresponding edge 72 of the upper end panel 24.

The upper end panel 24 is generally rectangular in shape and includes receptacle features or structures 39 that consist of partially punched out portions of the panel 24. These punched out structures form a receptacle 39 configured to receive corresponding tabs 38 on the upper connecting extensions 32 when the casket body 11 is in the first configuration. The upper end panel 24 also includes on each of its shorter sides a detent feature 70. The detent feature 70 is configured to be received by the slot 44 of a corresponding side panel 14 during assembly into the first configuration.

Referring again to FIGS. 1 and 3, the casket assembly 10 and casket body 11 include a first end 11*a* and a second end 11*b*. In the embodiment described herein, the superior extremity (head) of the deceased is intended to be disposed proximate to the first end 11*a*, and the inferior extremity (feet) of the deceased is intended to be disposed proximate to the second end 11*b*.

Figure 10:
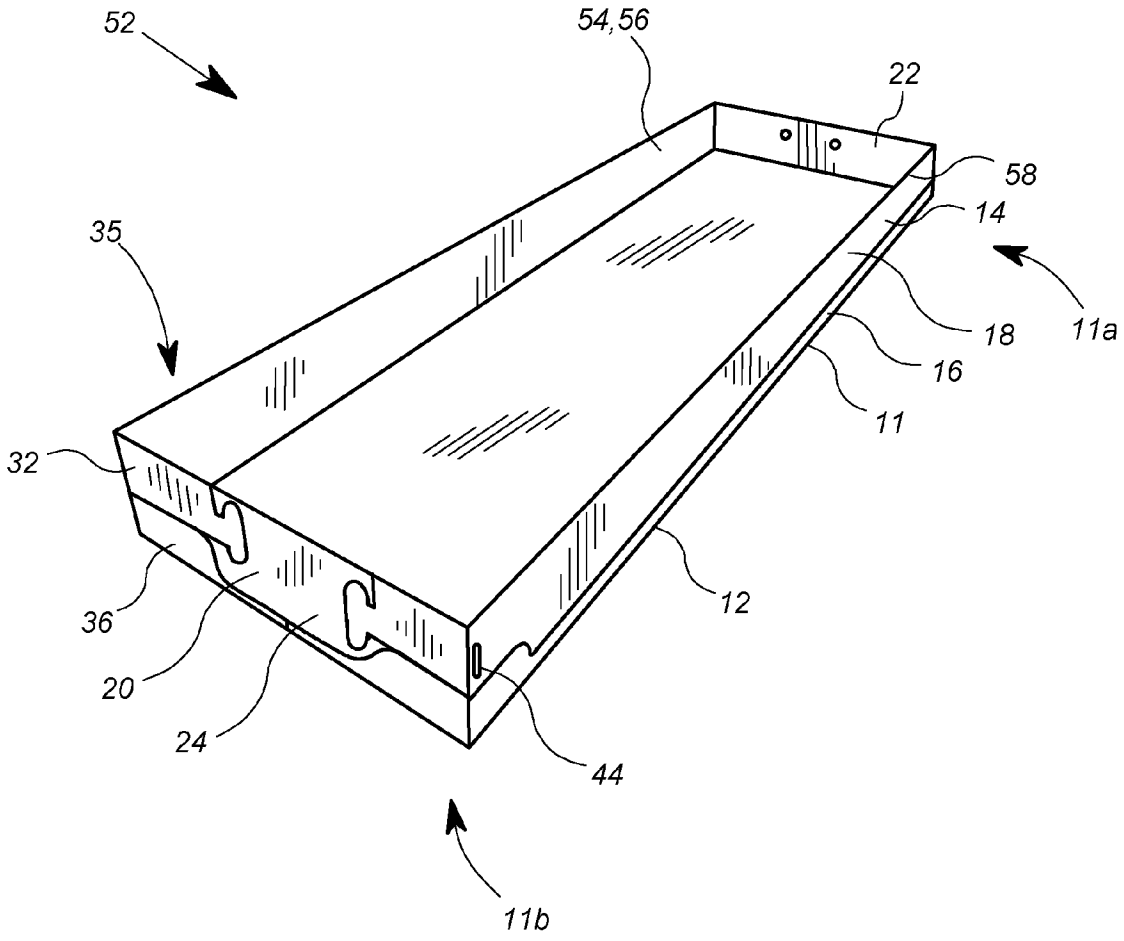
FIG. 10 shows a perspective view of the casket body with insert as assembled in a third or second alternative configuration.

It is intended in some cases that the casket arrangement 10 be used as an insert to a wooden or metal (or other) ornate rental casket structure. The intention is that the body, within the casket arrangement 10, may be inserted into an end of the rental casket (not shown) for viewing purposes. In such a case, the upper sections 18 and upper end panels 24 may be arranged in a third configuration, or alternative second configuration, in which they are folded outwardly and downwardly so that they are adjacent to the outer surfaces of the respective lower sections 16 and lower end panels 22. This third or alternative second configuration may be used for display of the body within the casket arrangement 10, the casket arrangement 10 disposed within the rental casket. The upper sections 18 and upper end panels 24 are folded down so that the casket arrangement does not inhibit views of the body during display thereof. In many cases, the rental casket (not shown) will have an elevation device (not shown) that lifts at least the first end 11*a* of the casket arrangement 10 upward within the rental casket to allow for better viewing. The third or alternative second configuration is shown in FIG. 10.

Referring again to FIGS. 1, 3, and 5, to form the casket body 11 into a first configuration suitable for receiving a body, end panels 20 are folded along edge 68 into a substantially vertical position. Inserting detent features 70 into the slots 44 at each end of the casket helps to stabilize the structure during assembly. The lower connecting extensions 36 are then folded along the edge shared with the lower sections such that the lower connecting extension is substantially perpendicular to the lower section and such that holes 34 substantially align with holes 37. The lower connecting extension 36 and lower end panel 22 are secured together with a cable tie 40 routed through holes 34, 37 formed therein. Similarly, the upper connecting extensions 32 are folded along the edge shared with the upper sections 18 such that the upper connecting extensions 32 are substantially perpendicular to the upper sections 18. Tabs 38 are received into the receptacles 39. The tab 38 is folded along the edge common to the tab 38 and the upper connecting extension 32 to secure the tab 38 in place.

Reference is now made to FIGS. 3 and 5. When the casket arrangement 10 is used with a rental unit (not shown), access to a latch at one end of the rental unit is helpful for removal of the casket arrangement 10. By providing access to the latch on the rental unit, the casket arrangements 10 can be made to fit more snugly into the rental unit. To this end, cutouts 33 and 35 provide a lower profile at one end of the casket body 11. Cutouts 33 are located at the corners of the upper sections 18 at one end 11*b* of the casket body 11 and cutouts 35 are located at the corners of the upper end panel 24 provide this access. When assembled into the first configuration, cutouts 33, 35 provide a lower profile at one end 11*b* of the casket arrangement 10, thus allowing access to the latch on the rental unit.

Referring again to FIGS. 1 and 3, lid 30 is configured to fit over the casket body 11. The lid has a generally rectangular shaped top 29 and has a first and a second side panel 31 and a first and a second end panel 27. The side panels 31 are also generally rectangular in shape and are coupled to the top 29 along an elongate edge. Similarly, the end panels 27 are rectangle shaped and attached to the top 29 along an elongate edge. The side and end panels 31, 27 extend downward from the lid in a substantially perpendicular manner. The corners of the lid 30 created by the intersections of the side and end panels 31, 27 are secured into place using any method commonly known in the art. The lid 30 fits over the top of the casket body 11 such that the bottom surface of the lid top 29 is resting or nearly resting on the top edges of the end panels 20 and side panels 14 of the casket body 11. This disposition of the lid prevents the lid from adding additional height to the profile of the assembly shown in FIG. 1.

Referring again to FIGS. 1, 3, and 5, a first and a second handhold 48 are shown formed into the lower sections 16 of the side panels 14. The handholds are formed by partially punching out pieces of the lower sections. The handholds 48 are spaced along the lower sections such that they are off-center towards one end 11*a* of the casket body 11. To state it another way, the distances of the handholds 48 from one end 11*a* of the casket, when averaged together, is less than the distance from that same end 11*a* to the center of the side panel. Spacing the handholds 48 in this manner allows for a more even weight distribution of the deceased disposed within the casket.

Figure 4:
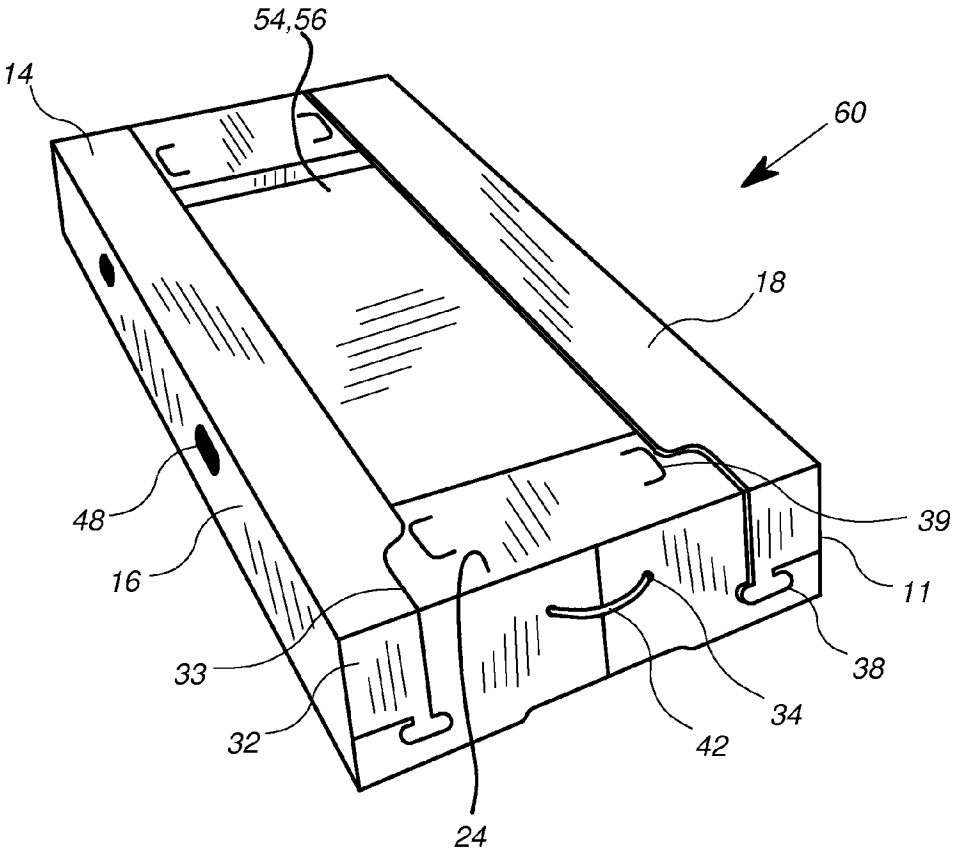
FIG. 4 illustrates a perspective view of the casket body with insert as assembled in a second configuration.

Referring now to FIGS. 2, 4 and 5, the casket arrangement 10 includes a casket body 11, an insert 54 with liner 56 (discussed below), and a lid 30. The casket body 11 can be arranged into a second configuration. This configuration, because of its lower profile, may be more suitable for shipping and storage. To adapt the casket from the first configuration to the second configuration, the tabs 38 are uncoupled from receptacles 39. Detent mechanism 70 is also uncoupled from slot 44. The upper end panels 24 are folded towards the cavity of the casket body 11 to a position substantially perpendicular to the lower end panels 22. The detent mechanism 70 is inserted into a slot 46 which is configured to receive the detent mechanism and is located along edge 58 near one end 11*b* of the casket body 11. Slot 46 is also substantially perpendicular to slot 44. Inserting the detent mechanism 70 into slot 46 aids in the adaptation of the casket body 11 from the first configuration to the second configuration by maintaining the non-vertical position of the upper end panel 24. The upper sections 18 then fold down toward the cavity of the casket body 11 in a direction substantially perpendicular to the lower sections and abut the outer surface of the upper end panel 24. The upper connecting extension 32 is folded such that it is approximately perpendicular to the upper section and such that it abuts the outer surface of the lower connecting extension 36. Lid 30, is configured such that the bottom surface of the lid top 29 abuts the top surfaces of the upper sections 18 in the second configuration and such that the inner surfaces of the lid end panels abut the upper connecting extensions 32. It can be appreciated that the short sides of the end panels and side panels, and thus the height of the lid is such that when the casket body 11 receives the lid 30, the profile of the casket arrangement 10 is substantially unchanged.

Referring now to FIG. 4, a handle 42 may be attached to the casket using the holes 34, 37 located at one end 11*b* of the casket. The handle can be a tubular material such as a section of tubing with a cable tie therethrough, though the material is preferably combustible. The handle aids in removing the casket arrangement 10 from the rental unit (not shown) through the foot end panel of the rental unit (not shown).

Referring now to FIGS. 6-9, the casket insert 54 includes a center panel 78; a first and second insert side panel 80; and a first and second insert end panel 82. The center panel 78, the insert side panels 80, and the insert end panels 82 are preferably formed from a single piece of pliable material, such as corrugated paperboard. To this end, a specially configured blank 76 is first stamped from a continuous piece of paperboard, and then folded to form the casket insert 54. The center panel 78 is rectangular in shape and sized slightly smaller than the bottom panel 12 of the casket body 11. The center panel 78 is foldably attached along edge 86 to the insert side panel 80. The insert side panel 80 is rectangular shaped and sized such that the elongate edge is slightly less than the elongate edge of the lower section 16, and the short edge of the insert side panel 80 is slightly less than the short edge of the lower section 16. Similarly, the insert end panels 82 are also rectangular in shape and are foldably attached to the center panel 78 along edge 88. The insert end panels 82 are sized such that the elongate edge is slightly less than the elongate edge of the lower end panel 22 and the short edge of the insert end panel 82 is slightly less than the short edge of the lower end panel 22. The insert side panels 80 and insert end panels 82 are folded substantially perpendicular to the center panel to form a tray structure. The insert 54 is sized such that when the tray structure is disposed within the assembled casket body 11, the tray structure is maintained.

Figure 7:
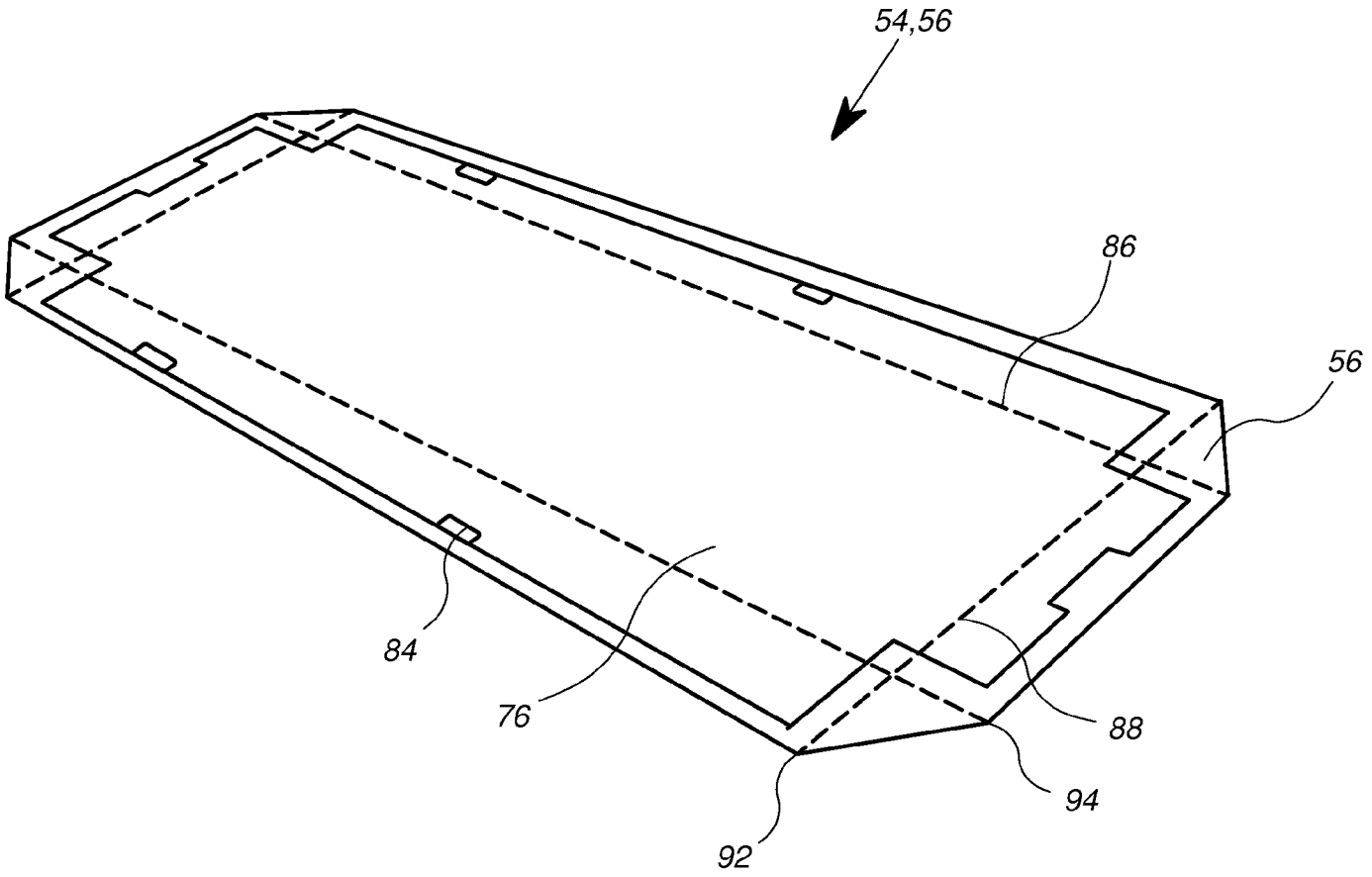
FIG. 7 shows a perspective view of the insert partially covered in a leak resistant material.
Figure 8:
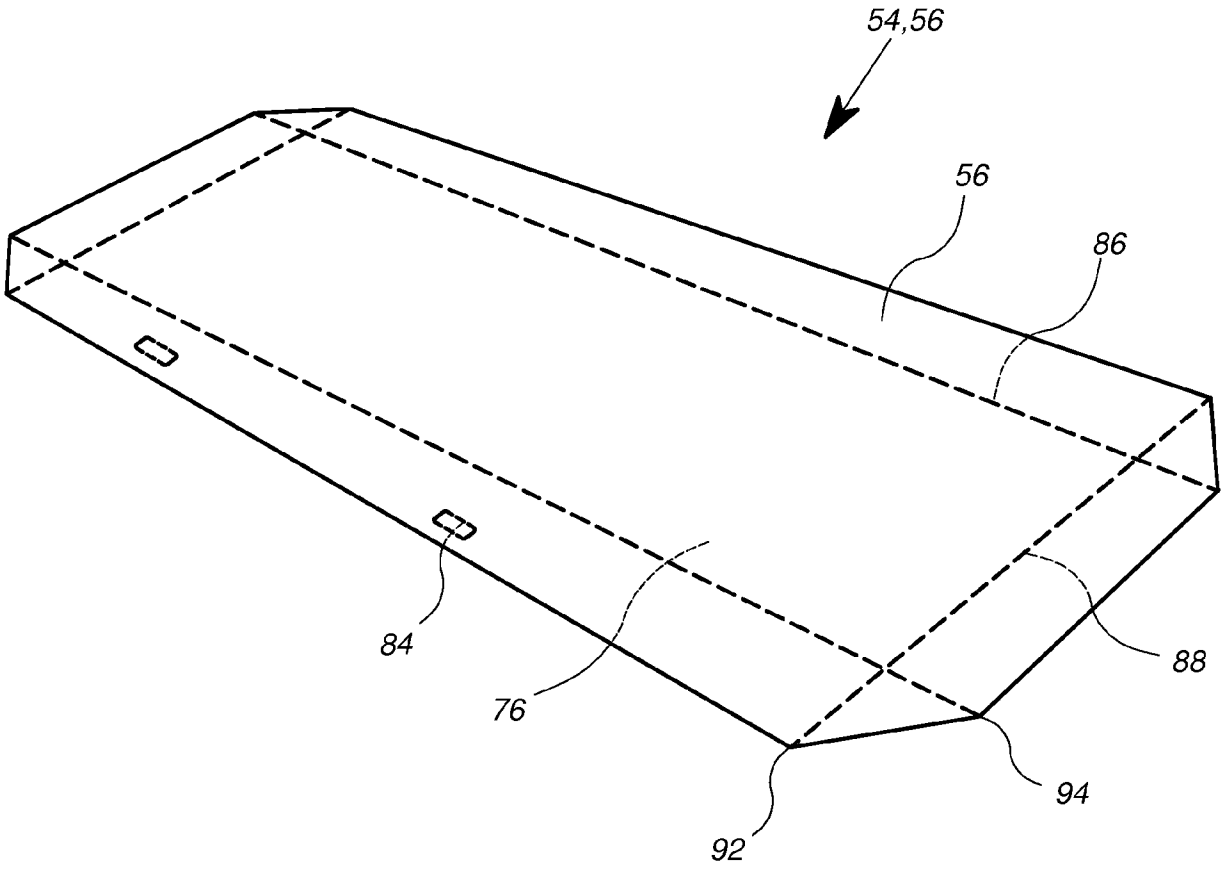
FIG. 8 shows a perspective view of the casket insert.

Referring again to FIG. 6, the insert side panels 80 contain handholds 84 formed therein by partially punching out pieces of the material. The number and location of these handholds 84 correspond to the number and location of the handholds 48 of the casket body 11. Insert end panels 82 may contain notch cutouts 83 along the outer edge. The insert is wrapped with a leak resistant material 56. In one embodiment, the material is a LDPE sheet of plastic. The plastic is wrapped around the top surface of the blank 76 and extends around to the bottom surface of the blank 76 on all four sides as shown in FIG. 7. The plastic 56 is then secured to the blank 76 using glue or hot-melt adhesive. In alternative embodiments, staples may be used. The handholds 84 are left uncovered by the plastic on the bottom surface of the blank 76.

Figure 9:
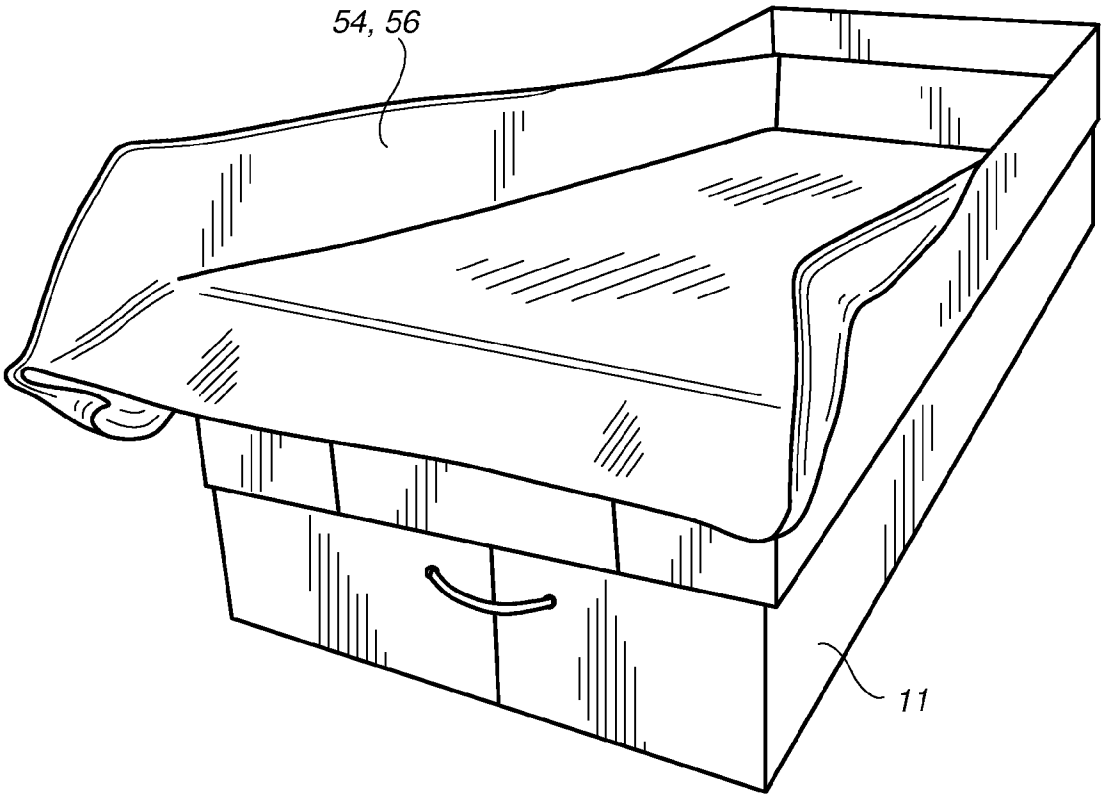
FIG. 9 shows an assembly view of the casket body receiving an insert.

Referring now to FIG. 9, the casket body 11 can be adapted into a first configuration or the alternative second configuration to allow the disposition of the insert 54 covered in plastic 56 within the casket body 11. The casket insert 54 is attached to the casket body 11 with adhesive placed between the top surface of the bottom panel 12 and the bottom surface of the insert center panel 78. When the casket insert 54 is covered with a leak resistant material 56, and disposed into the casket body 11, it can be appreciated that bearer of the casket is protected from the contents of the casket because the leak resistant material acts as a barrier between the bearers hand in the aligned handholds 48, 84 and the contents of the casket.

Referring again to FIGS. 1 and 2, the casket insert 54 and liner 56 can be disposed within the casket body 11 in either the first configuration (FIG. 1) or the second configuration (FIG. 2). The casket insert 54 and liner 56 can also be disposed within the casket body 11 in a third configuration or alternative second configuration (not shown).

Additionally, many detailed features have been disclosed herein that provide additional advantages beyond those of the present invention, or indeed enhance the present invention. It will be appreciated that many of the advantages of the present invention may be obtained without such detailed features. Accordingly, the claims defined below are not intended to incorporate portions or details of the disclosed embodiments that are not expressly recited in the claims. The principles of the present invention have widespread applications and may be incorporated into any number of designs by those of ordinary skill in the art.

As discussed above, the casket arrangement 10 may be used as a rental insert casket that is temporarily inserted into a more ornate casket shell, or may be used as a standalone casket.

We claim:

1. A casket arrangement having a first configuration and a second configuration, comprising:

a casket bottom formed of a pliable material;

side panels coupled to the casket bottom and formed of the pliable material, each side panel having a first length and including a lower section and an upper section foldably attached thereto, the lower section extending vertically upward from the casket bottom, the upper section in the first configuration extending upward from a top portion of the lower section and in the second configuration extending in a direction other than vertically upward from the top portion of the lower section;

end panels coupled to the casket bottom and formed of the pliable material, each end panel having a second length that is less than the first length;

flaps extending laterally from, and foldably attached to, each end of each upper section, the flaps in the first configuration disposed completely at or above a first vertical level defined by the top portion of the lower section, and in the second configuration extending downward from the first vertical level;

wherein the casket bottom, the side panels, the flaps and the end panels form a casket body at least in the first configuration; and wherein the flaps of opposing upper sections extend from their respective upper sections toward each other in the first configuration.

2. The casket arrangement of claim 1, wherein each flap in the first configuration is operably coupled to a corresponding one of the end panels, and each flap in the second configuration is decoupled from the corresponding one of the end panels.

3. The casket arrangement of claim 2, further comprising lower connecting extensions extending laterally from, and foldably attached to, each end of each lower section, the lower connecting extensions foldably movable with respect to said lower section independent of said flaps.

4. The casket arrangement of claim 3, wherein at least a first flap has a surface abutting a surface of a first lower connecting extension in the second configuration.

5. The casket arrangement of claim 1, further comprising lower connecting extensions extending laterally from, and foldably attached to, each end of each lower section, the lower connecting extensions foldably movable with respect to said lower section independent of said flaps.

6. The casket arrangement of claim 5, wherein a first flap of the flaps is foldably attached to a first of the upper sections via a first fold line, a first lower connecting extension is foldably attached independent of the first flap to a first of the lower sections via a second fold line, and wherein the first fold line and the second fold line are collinear in the first configuration.

7. The casket arrangement of claim 1, wherein the casket bottom comprises a bottom panel, and further comprising:

a casket insert disposed over and substantially covering the bottom panel, the casket insert having a center panel disposed on the bottom panel.

8. The casket arrangement of claim 7, wherein the casket insert further comprises insert side panels and insert end panels foldably connected to the center panel to form a tray structure.

9. The casket arrangement of claim 8, wherein the casket insert further comprises a leak resistant liner disposed at least over the center panel.

10. A casket arrangement having a first configuration and a second configuration, comprising:

a bottom panel formed of a pliable material;

side panels formed intrinsically with the bottom panel of the pliable material, each side panel including a lower section and an upper section formed therewith, the lower section extending vertically upward from the bottom panel, the upper section in the first configuration extending upward from the lower section and in the second configuration extending in a direction other than vertically upward from the lower section;

end panels formed intrinsically with the bottom panel of the pliable material, each end panel including a lower end panel, and an upper end panel, the lower end panel extending vertically upward from the bottom panel and fixed in position, the upper end panel in the first configuration extending upward from the lower end panel and operably coupled to the upper section of at least one side panel, and the upper end panel in the second configuration extending in a direction other than vertically upward from the lower end panel;

a casket insert disposed over and substantially covering the bottom panel, the casket insert having a center panel disposed on the bottom panel;

a first lower connecting extension foldably attached to the lower section of a first of the side panels at a first end of the first of the side panels, the first lower connecting extension secured to a first of the lower end panels; and a first upper connecting extension foldably attached to the upper section of the first of the side panels at the first end of the first of the side panels, the first upper connecting extension foldably moveable independent of the first lower connecting extension; and wherein the bottom panel, the side panels, and the end panels form a casket body in at least the first configuration.

11. The casket arrangement of claim 10, wherein the first upper connecting extension is coupled in the first configuration to a first of the upper end panels while said first lower connecting extension is secured to the first of the lower end panels, and is the first upper connecting extension is decoupled in the second configuration from the first of the upper end panels while said first lower connecting extension is secured to the first of the lower end panels.

12. The casket arrangement of claim 10, further comprising a lid disposed over the side panels, the end panels, the bottom panel and the casket insert in the first configuration and the second configuration.

13. A casket arrangement having a first configuration and a second configuration, comprising:

a bottom panel formed of a pliable material;

side panels formed intrinsically with the bottom panel of the pliable material, each side panel including a lower section and an upper section formed therewith, the lower section extending vertically upward from the bottom panel, the upper section in the first configuration extending upward from the lower section and in the second configuration extending in a direction other than vertically upward from the lower section;

end panels formed intrinsically with the bottom panel of the pliable material, each end panel including a lower end panel, and an upper end panel, the lower end panel extending vertically upward from the bottom panel and fixed in position, the upper end panel in the first configuration extending upward from the lower end panel and operably coupled to the upper section of at least one side panel, and the upper end panel in the second configuration extending in a direction other than vertically upward from the lower end panel;

a casket insert disposed over and substantially covering the bottom panel, the casket insert having a center panel disposed on the bottom panel;

wherein the bottom panel, the side panels, and the end panels form a casket body in at least the first configuration; and wherein the casket insert further comprises insert side panels and insert end panels foldably connected to the center panel to form a tray structure.

14. The casket arrangement of claim 13, wherein the casket insert further comprises a leak resistant liner disposed at least over the center panel.

15. The casket arrangement of claim 13, wherein the center panel, the insert side panels and the insert end panels are formed from a single piece of corrugated paperboard.

16. The casket arrangement of claim 13, each of the insert end panels includes a notch cutout along an outer edge thereof.

17. The casket arrangement of claim 16, wherein each of the insert end panels has a first edge foldably attached to the center panel, and an opposite edge that includes the notch cutout.

18. The casket arrangement of claim 13, further comprising:

a first lower connecting extension foldably attached to the lower section of a first of the side panels at a first end of the first of the side panels, the first lower connecting extension secured to a first of the lower end panels; and a first upper connecting extension foldably attached to the upper section of the first of the side panels at the first end of the first of the side panels, the first upper connecting extension foldably moveable independent of the first lower connecting extension.

* * * * *